US005936172A

United States Patent [19]

de La Rochefordiere

[11] Patent Number: 5,936,172

[45] Date of Patent: Aug. 10, 1999

[54] MUSICAL METHOD FOR MUSICAL INSTRUMENTS SUCH AS PIANOS, AND A PEDAL MECHANISM THEREFOR

[75] Inventor: Denis M. X. de La Rochefordiere, Ville d'Avray, France

[73] Assignees: Denis M.X. de la Rochefordiere, Ville d'Avray, France; Eric Drulang, Rabat, Morocco

[21] Appl. No.: 08/882,777

[22] Filed: Jul. 15, 1997

Related U.S. Application Data

[63] Continuation-in-part of application No. PCT/FR96/00090, Jan. 19, 1996.

[30] Foreign Application Priority Data

Jan. 31, 1995 [FR] France ..... 95 01078

[51] Int. Cl.[6] ..... G10C 3/00

[52] U.S. Cl. ..... 84/217; 84/255; 84/426

[58] Field of Search ..... 84/217, 216, 218, 84/255

[56] References Cited

U.S. PATENT DOCUMENTS 4,852,445 8/1989 de La Rochefordiere ..... 84/218
5,287,787 2/1994 Satoshi ..... 84/240

*Primary Examiner*—William M. Shoop, Jr.
*Assistant Examiner*—Shih-yung Hsieh
*Attorney, Agent, or Firm*—Young & Thompson

[57] ABSTRACT

A mechanism including a sustaining bar (112) directly engaging a row of damper supports (104); and a harmonic bar directly engaging a row of escapements (13) each of which is combined with one of the damper supports. Both bars (111, 112) are actuated by a common pedal (1) to which they are connected by a linkage system (18, 20, 5) linking the movement of the harmonic bar (111) to that of the sustaining bar (112) so that when the pedal is depressed beyond a so-called "harmonic" position in which the pedal is half-depressed, the sustaining function is applied to all the notes whose keys are depressed, and once the pedal has been fully depressed and is therefore in a so-called "forte" position, then very slightly released, all the escapements are in engagement with the harmonic bar.

8 Claims, 10 Drawing Sheets

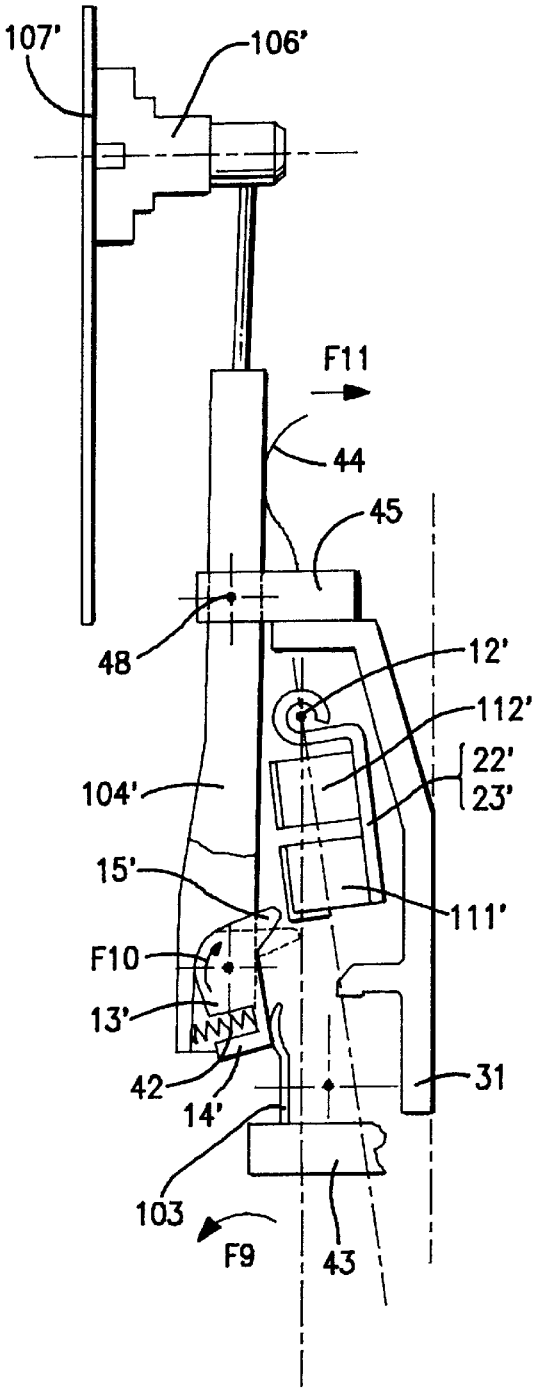
FIG. 7
FIG. 8
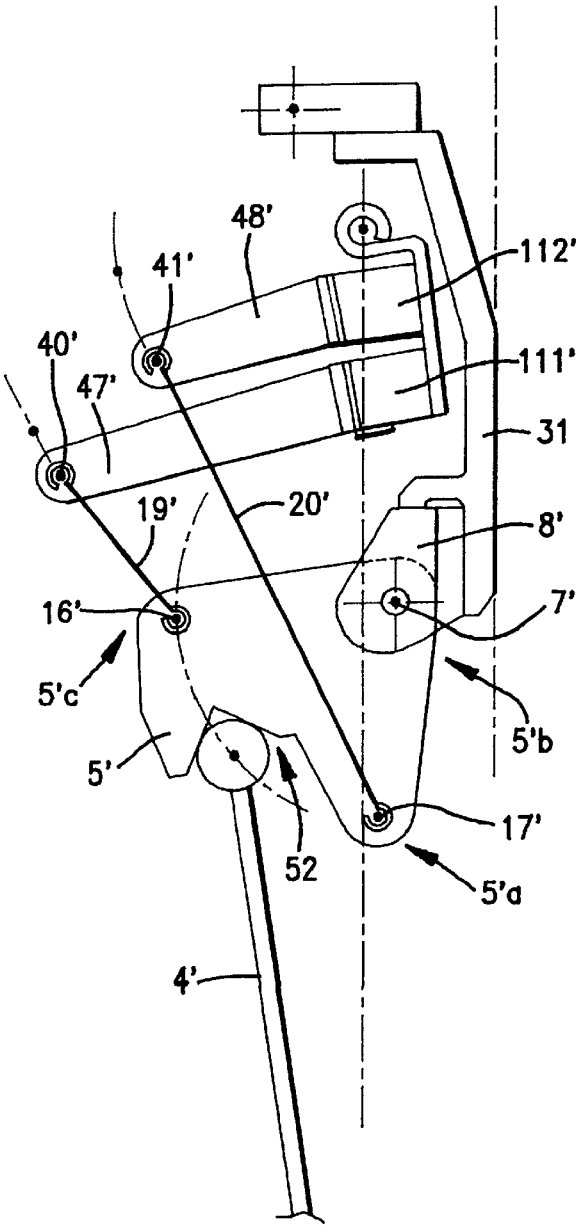

MUSICAL METHOD FOR MUSICAL INSTRUMENTS SUCH AS PIANOS, AND A PEDAL MECHANISM THEREFOR

This application is a continuation-in-part of international application PCT/FR96/00090 filed Jan. 19, 1996, which designated the United States.

Musical method for musical instuments such as pianos and mechanism therefor.

The present invention relates to a musical method for traditional musical instruments comprising a keyboard and struck strings, such as pianos, and to a mechanism for realizing said method.

The mechanism according to the invention is of the type that comprises a set of strings each capable of being struck by a hammer actuated by a key, each string being provided with a damper which, when not acted upon, presses on the string and prevents it from vibrating and which, when acted upon, is moved away from the string.

The dampers are acted upon either:

all simultaneously by a sustaining bar that acts directly on a row of supports, each of which is connected to one of said dampers, or by a harmonic bar that acts on a row of escapements, each of which is connected to one of said damper supports, said bars being operated by a dual-action pedal which when half depressed is in the so-called "harmonic position" and when fully depressed is in the so-called "sustaining position"; or individually, by a part, known as the "rear end", of the key or by a spoon connected to said key.

The harmonic bar and the sustaining bar have the function of moving all the dampers away from the strings. However, the harmonic bar, unlike the sustaining bar, leaves the damper supports accessible to said rear ends of the keys.

More precisely, the invention relates to a mechanism for ensuring that a player can interrupt the effect of the sustaining bar on notes about to be played, while continuing this effect on notes that have just been played, by means of which mechanism it is possible for arpeggios that were played in the sustaining position to continue to resonate and to be held on in the harmonic position.

A mechanism of the above-mentioned kind is known, for example, from patent EP-0 271 527 in the name of Denis de La ROCHEFORDIERE, which mechanism is illustrated schematically in FIG. 1. In this known mechanism, as applied to an upright piano, each string 107 has a damper 106 which is acted upon by two separable escapement means, one of which is an escapement fillet 110 fixed to a harmonic bar 111 operated by a harmonic pedal—which is advantageously the sustaining pedal, the harmonic position corresponding to the half-depressed pedal, whereas the sustaining position corresponds to the fully depressed pedal—and the other of which is an escapement spring 109 fastened to the damper 106 support 104. In this method, turning the harmonic bar 111 in direction $F_1$ causes a movement of the escapement fillet 110 that acts on the escapement spring 109 with which it is engaged so as to move the damper 106 away from the string 107. When a note is played in the harmonic position, a spoon 103 connected to the key 101 and acting directly on the damper support 104-causes the escapement means 109, 110 to separate when the key 101 is depressed and keeps the damper 106 off the string 107; the note vibrates until the key 101 is released and the damper 106 has returned to the string 107. The note is then damped, although the bass strings continue to vibrate sympathetically.

The mechanism disclosed in this prior document has the drawback, however, that when said key 101 is released, the escapement means 109, 110 do not move back into engagement with each other because the escapement spring 109 reverts to its rest position on the harmonic bar 111 whereas the escapement fillet 110 has turned through a certain angle A corresponding to the above-mentioned rotation of the harmonic bar 111. The consequence of this failure on the part of the escapement to reset itself causes difficulties for the pianist. The problem is that, as could be predicted, when a key is depressed while the pedal is in the harmonic position, and the pedal is then depressed all the way into the sustaining position, so that the sustaining bar 112 bears against the damper support 104, this note continues to vibrate because the damper 106 is being acted upon by the sustaining bar 112. However, when the pedal is once again released as far as the harmonic position, after the key 101 has been released, the damper 106 is no longer acted upon either by the sustaining bar 112 or by the spoon 103 fastened to the key 101; in addition, because the mechanism does not reset itself, the harmonic bar 111 is also out of action. The note is therefore damped. To avoid this type of annoyance, the pianist is compelled to release the pedal fully in order to reset the escapements 109, 110 of the key/string in question, before returning to the harmonic position. This release of the pedal has the effect of interrupting the vibration of any notes played in the sustaining position. Also, the transition between the "harmonic" and "sustaining" functions is insufficiently precise, and this is a source of additional errors.

SUMMARY OF THE INVENTION

The object of the invention is therefore to provide a musical method and a pedal mechanism that remedy these drawbacks of the known system.

This object is achieved in that the method according to the invention consists in linking the movement of said harmonic bar to that of said sustaining bar in such a way that:

(1) As soon as the dual-action pedal is depressed beyond the harmonic position, all the escapements are simultaneously placed out of reach of said rear end of said key or of said spoon. Thus, for the pianist, the sustaining function is applied to any note corresponding to a key that was released when the pedal was depressed beyond the harmonic position, and this whatever the position of the pedal at the instant said key was depressed. Furthermore, the transition between the harmonic and sustaining functions corresponds to a precise point in the travel of the dual-action pedal.

(2) Once said dual-action pedal has been depressed all the way into the sustaining position and then very slightly released, all the escapements are engaged by said harmonic bar.

In this way the harmonic bar and the escapements can re-engage with each other after a key has been first depressed and then released in the harmonic position, either by first totally releasing and then very slightly depressing the pedal, or by first depressing the pedal all the way into the sustaining position and then very slightly releasing it.

To this end, the mechanism according to the invention comprises a linkage system that connects the harmonic bar and the sustaining bar to the dual-action pedal.

In a preferred embodiment of the invention, the harmonic bar and the sustaining bar are each pivotably mounted and follow the movements of one end, the so-called "remote" end, of a link, the other end of which, the so-called "near" end, is caused to execute a pivoting movement by an actuation rod operated by the dual-action pedal.

In a first embodiment, the near end of each of the links follows the pivoting of a common part, termed the "crank plate", on which the actuation rod acts.

In a second embodiment, the near ends of said links follow the movements of two respective levers mounted so as to pivot on each other at one of their ends and connected to each other by spring means at their opposite end, said actuation rod acts on said opposite end of one of said levers and stop means are provided near the opposite end of the other of said levers.

In an embodiment adapted to the grand piano, each of the escapements is a piece that pivots freely between a position of abutment against the associated damper support and either a position of equilibrium defined by gravity (corresponding to another position of abutment against the damper support) or a position in which it bears on an interfering piece, which may be, for example, the so-called "rear" end of the associated key or the harmonic bar.

In an embodiment adapted to the upright piano, each of the escapements in a piece that pivots between two positions, with spring means tending to keep said escapement in one of said positions or return it thereto.

Advantageously, in both grand and upright pianos, each of said escapements possesses two areas of contact, one of these being able to come into contact with said rear end of the key or with said spoon while the other is able to come into contact with said harmonic bar.

BRIEF DESCRIPTION OF THE PREFERRED EMBODIMENTS

A clearer understanding of the invention will be gained from the following description which refers to the accompanying drawings, in which.

Figure 2:
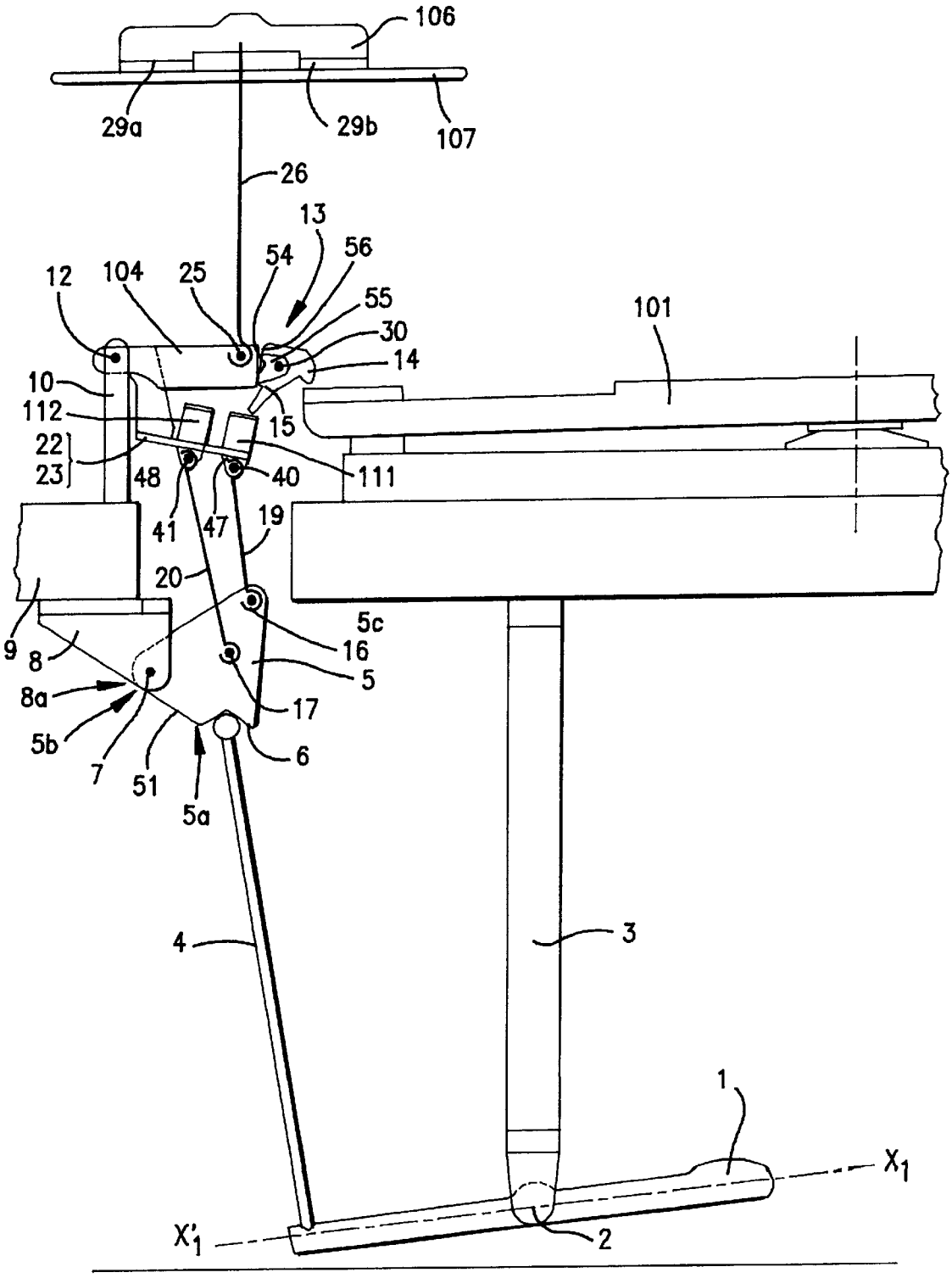
FIG. 2 is a schematic view of a first embodiment of the mechanism according to the invention at rest, applied to a grand piano.
Figure 4:
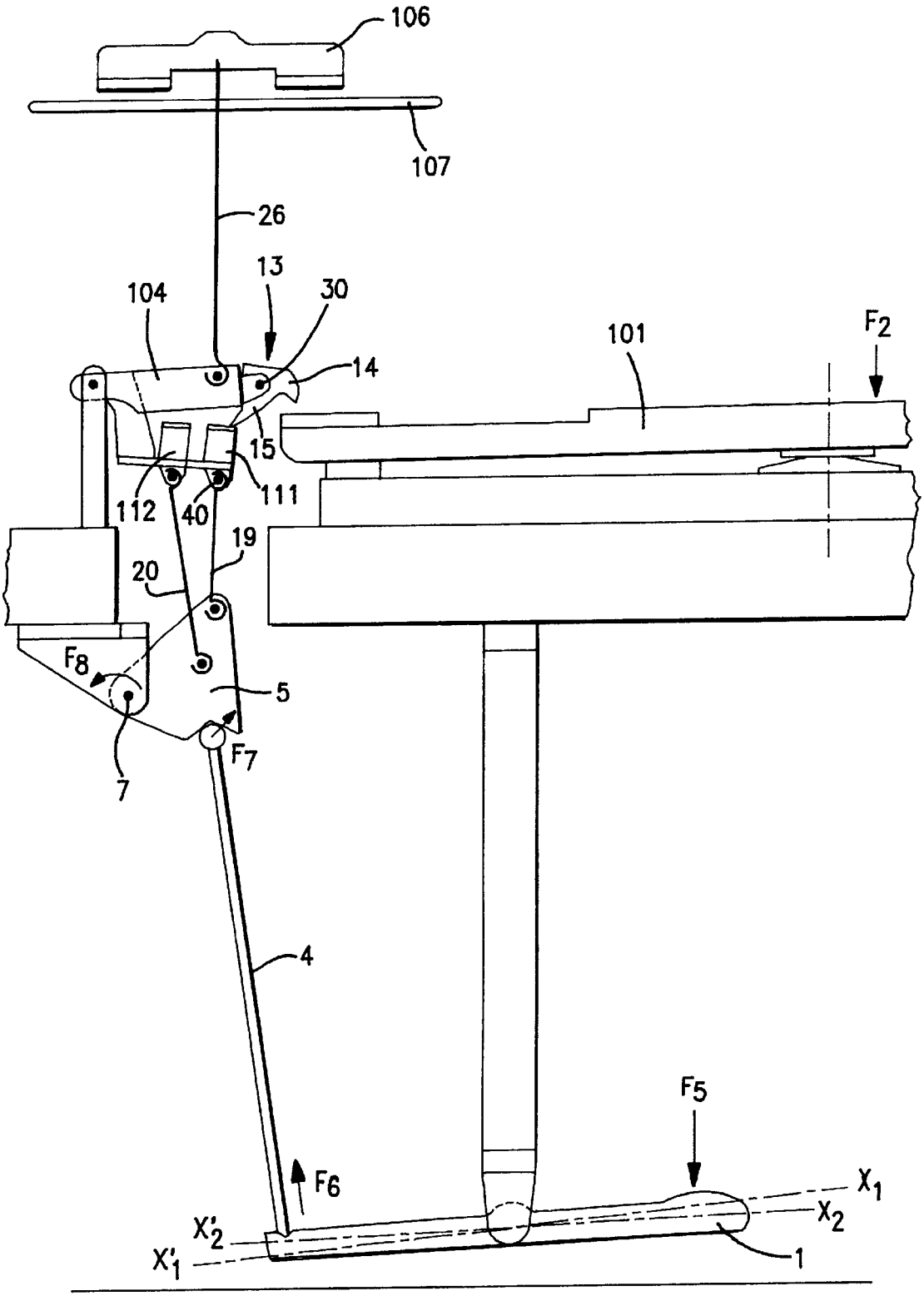
FIG. 4 shows the same embodiment as FIG. 2 but with the dual-action pedal depressed to the harmonic position, the key not being pressed down.
Figure 6:
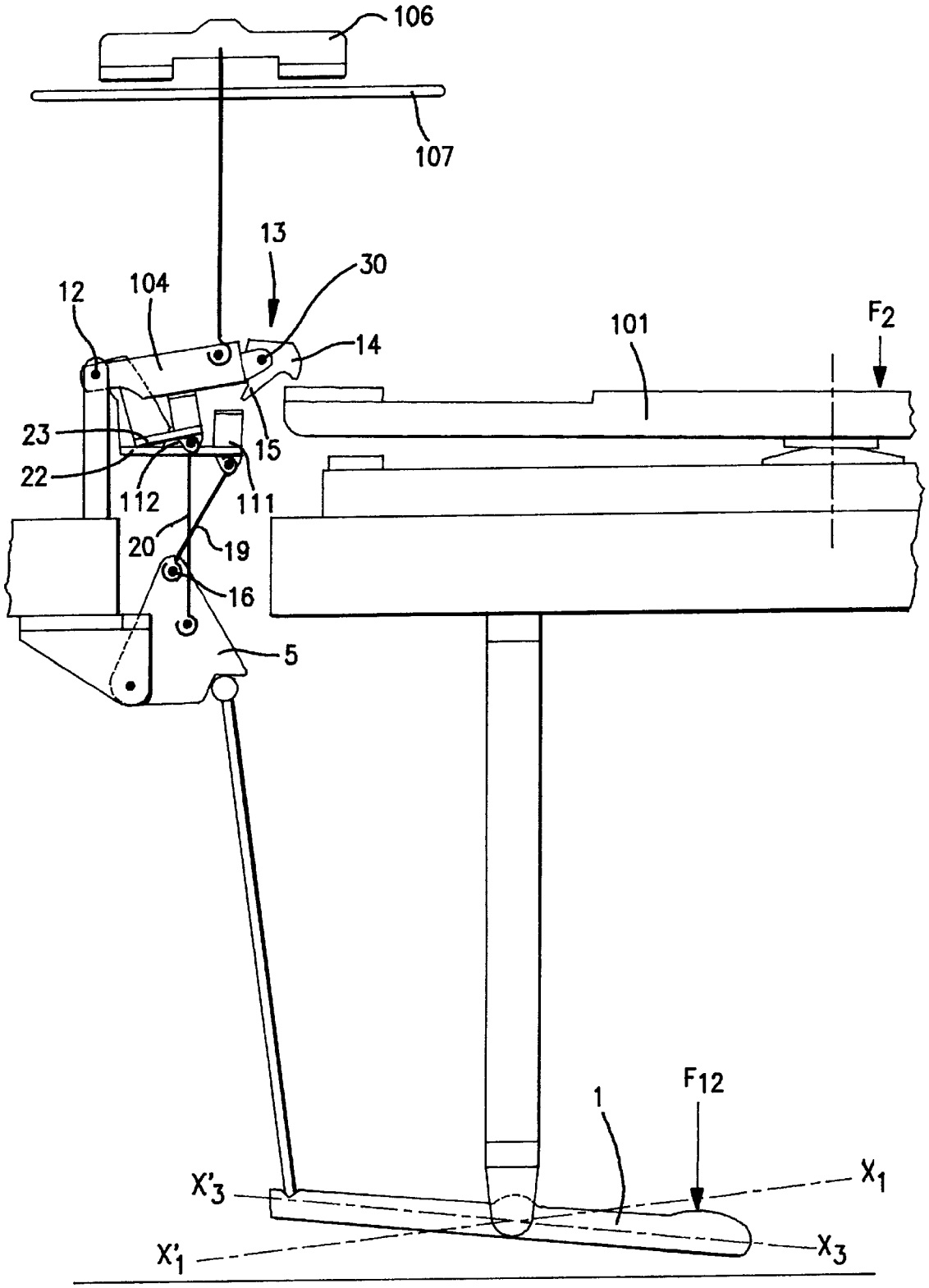
FIG. 6 shows the same embodiment as FIG. 2, but with the dual-action pedal pressed in the sustaining position.
Figure 9:
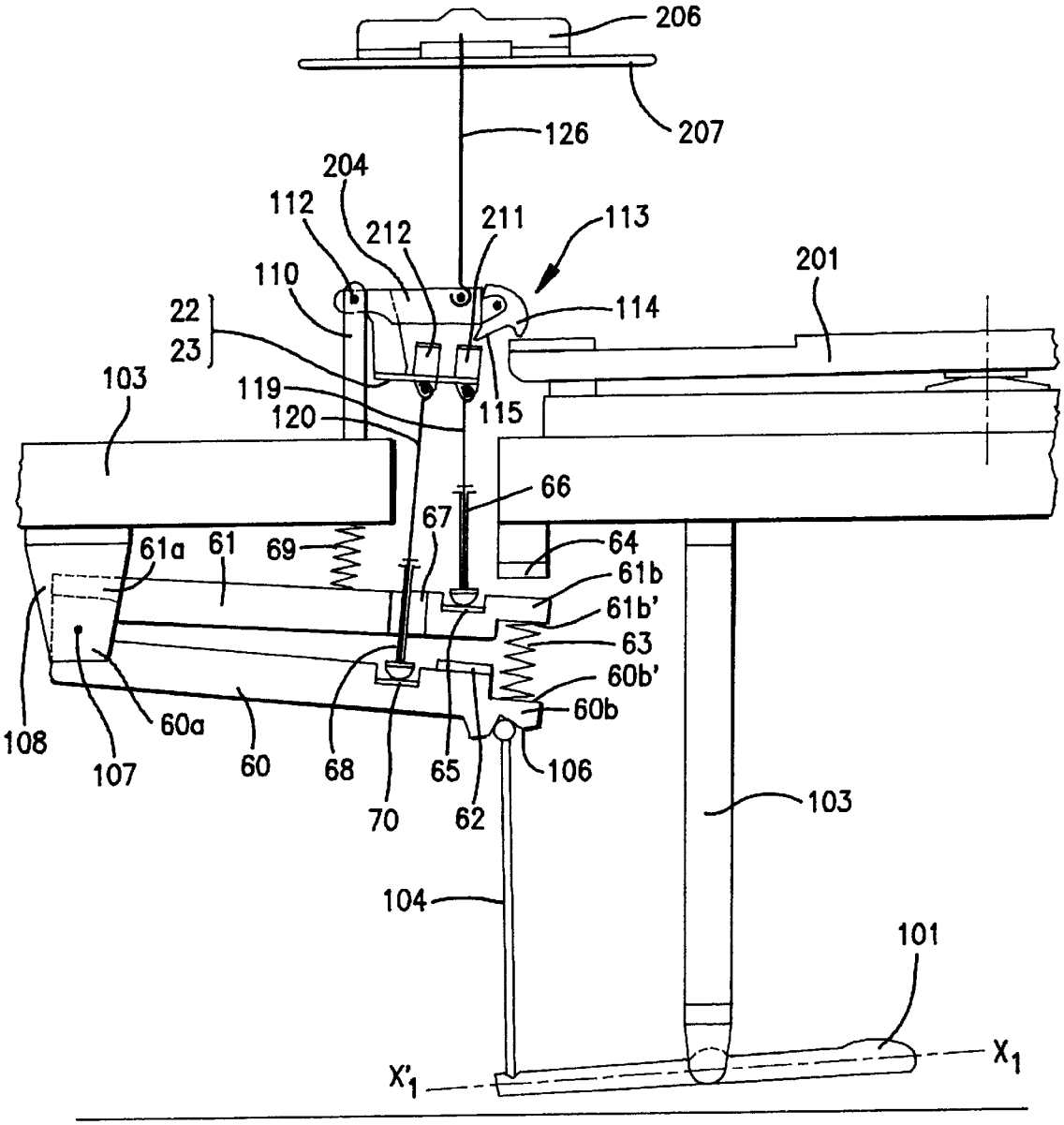
Figure 10:
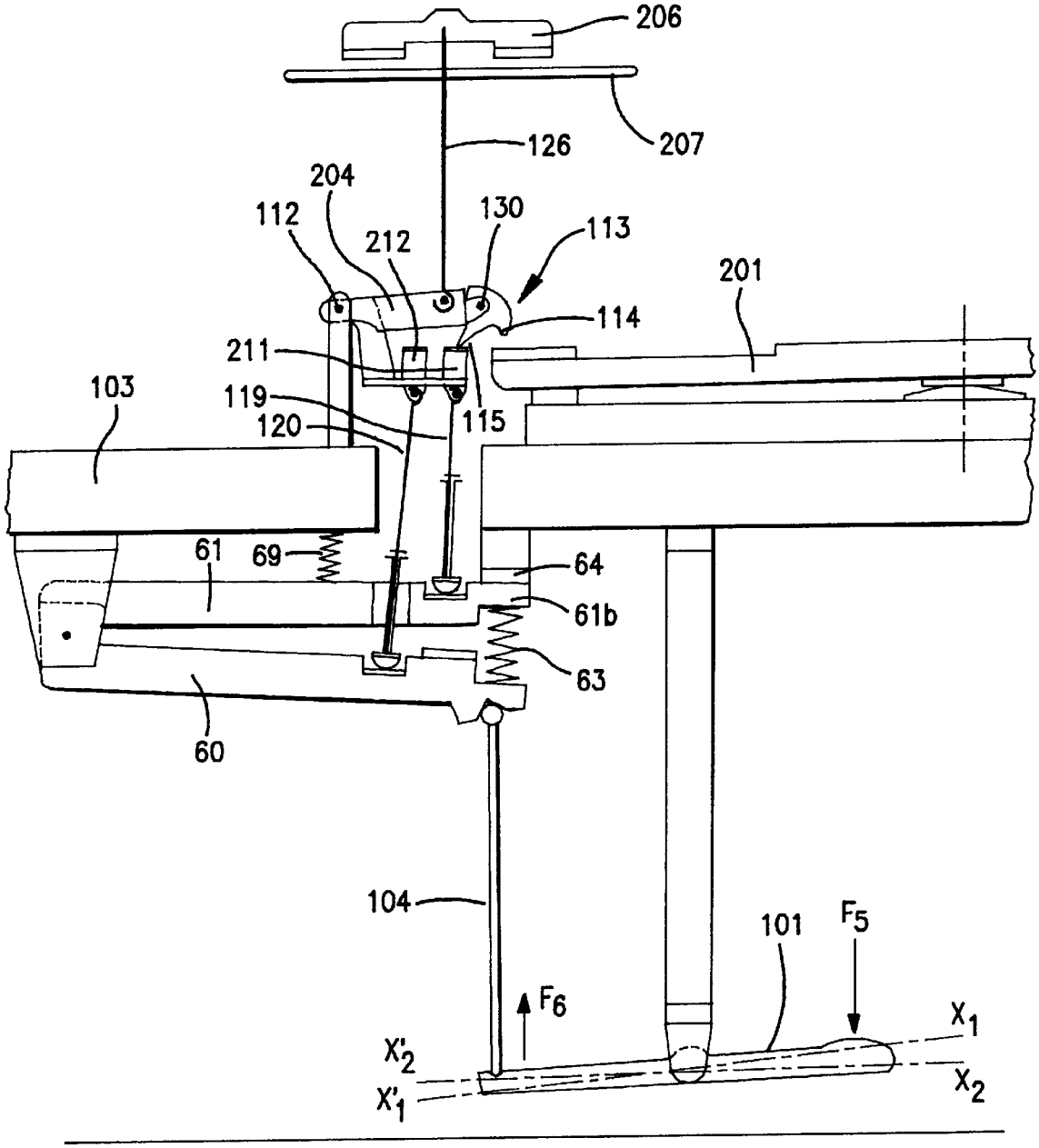
Figure 11:
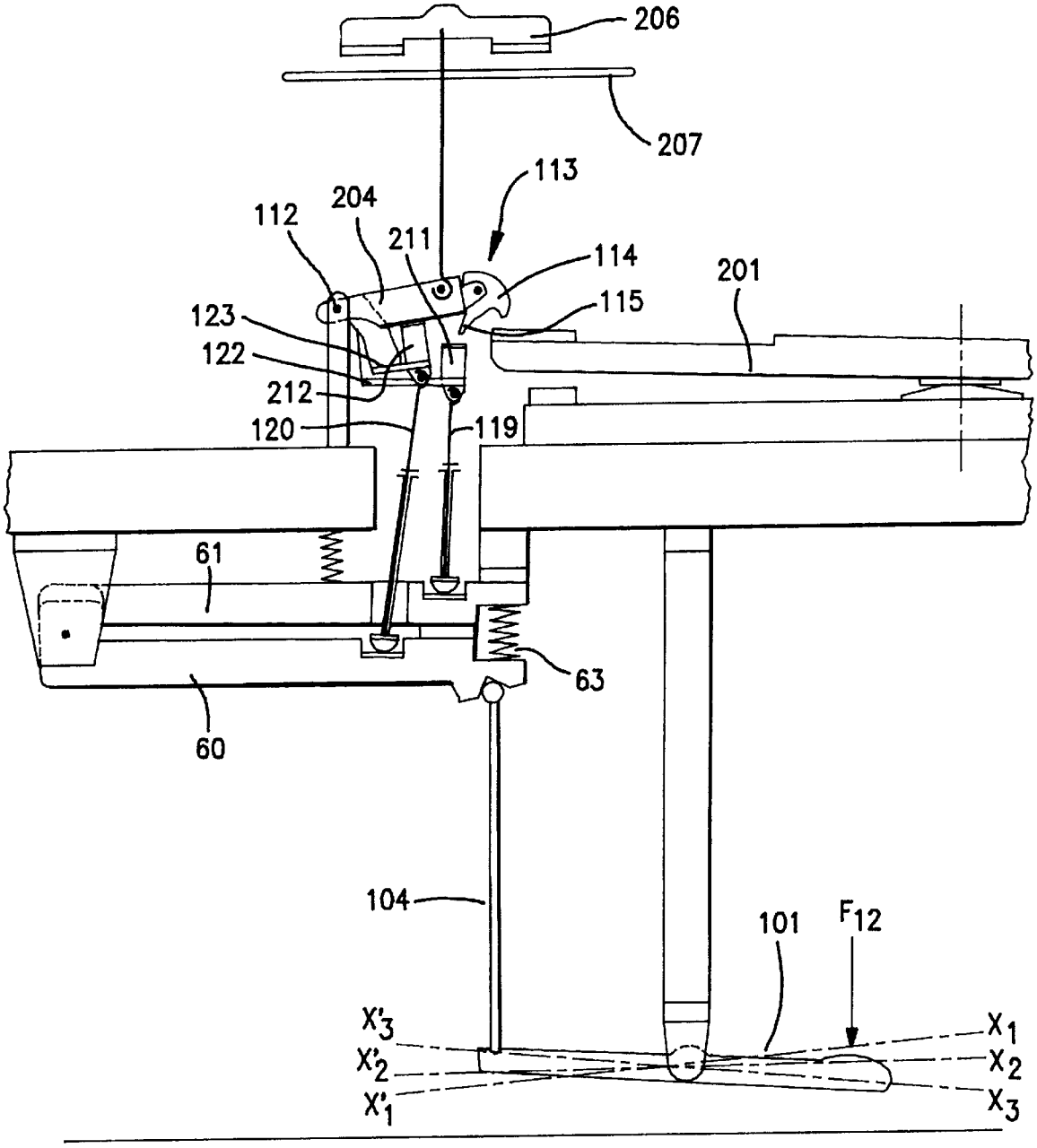

FIGS. 7 and 8 both show the same schematic embodiment of the mechanism according to the invention at rest, applied to an upright piano, FIG. 7 showing the escapement/damper portion without the linkage portion in order to keep the drawing clear and, conversely, FIG. 8 showing the linkage portion without the escapement/damper portion; and FIGS. 9 to 11 are views similar to FIGS. 2, 4 and 6, respectively, illustrating a second embodiment of the mechanism according to the invention.

DESCRIPTION OF THE PREFERRED EMBODIMENTS

As shown in FIG. 2, the mechanism according to the invention comprises, in a first embodiment, a pedal 1 whose general direction $X_1$–$X'_1$ forms, when at rest, an angle of approximately 30° to the horizontal, which pedal is mounted so as to pivot at its centre on a pin 2 mounted in a vertical bracket 3 belonging to a grand piano. The pedal 1 supports at its rear end, that is the opposite end from that operated by the pianist, one end of an actuation rod 4, roughly perpendicular to said pedal, the other or ball end of which engages with a crank plate 5, the general shape of which is that of a rounded equilateral triangle. For this purpose, the crank plate 5 includes at its vertex 5*a*, resting on the actuation rod 4, an approximately righ-tangled notch 6, though the notch does not have to be of this shape. When at rest, side 51 of the triangle 5, adjacent to said notch 6 and away from said pedal 1, forms an angle of approximately 45° to the horizontal and an obtuse angle with the portion of the actuation rod 4 external to the notch 6.

The crank plate 5 is hinged, at the other vertex 5*b* adjacent to said side 51, on a pin 7 fixed in the rounded vertex 8*a* of a yoke by which the crank plate 8 is supported and which is shaped approximately like a rightangled triangle whose hypotenuse is located, when the mechanism in at rest, in the continuation of said side 51 of the crank plate 5. The side of said yoke 8 opposite said rounded vertex 8*a* is fixed to the key bed 9, which is horizontal. A flange 10 extends perpendicularly to the key bed 9 on the opposite side from said yoke 8. The mechanism also includes a row of damper supports, such as 104, each of which corresponds to one key and one string. The damper support 104 corresponding to key 101 and string 107 will now be described. One end of said damper support 104 is connected to the free end of said flange 10 on which it pivots on a pin 12. At rest, the damper support 104 is horizontal. The other end of the damper support 104 forms an abutment surface 54 from which project two ears 55 supporting a pin 30 on which pivots an escapement 13, the latter comprising a nose 14, a tapering finger 15 and a stop surface 56. When at rest, the upper area of the stop surface 56 is away from the abutment surface 54 while the lower area of the stop surface 56 is against the abutment surface 54, so that the nose 14 of the escapement 13 is practically resting on the rear end of the key 101, that is to say on the opposite end of the key from that played by the pianist.

Figure 1:
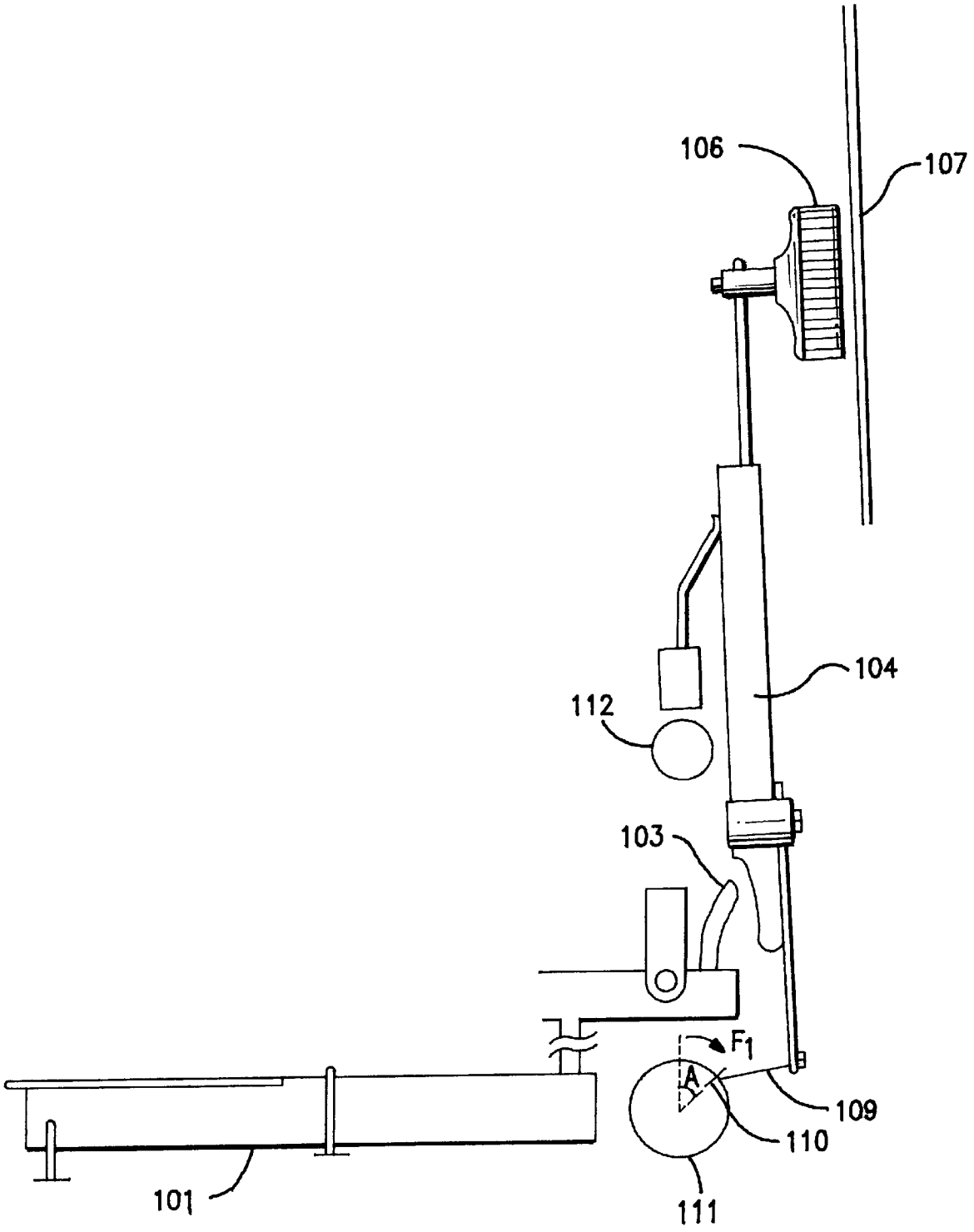
FIG. 1 PRIOR ART
FIG. 1 is, as indicated earlier, a schematic rendering of the configuration of the mechanism known from EP-0 271 527, in the situation in which the dual-action pedal is being held in the harmonic position, said mechanism being applied to an upright piano.

The third vertex 5*c* of the crank plate 5 supports a pin 16 about which is anchored, in a pivoting manner, one end of a link 19 whose other end is anchored in a pivoting manner about a pin 40 mounted on a plate 47 which is used for shifting a harmonic bar 111. Mounted approximately in the center of the crank plate 5 is a pin 17 about which is anchored, in a pivoting manner, one end of a link 20 whose other end in anchored in a pivoting manner about a pin 41 mounted on a plate 48 which is used for shifting a sustaining bar 112. The harmonic and sustaining bars 111 and 112, respectively, which are approximately parallel in the situation shown in FIG. 1, are respectively supported by a series 22 of four harmonic bar supports and a series 23 of four sustaining bar supports, which series of supports 22, 23 are pivoted on the aforementioned pin 12. In FIGS. 2 to 5, series 23 of supports hides series 22 of supports. They are visible separately in FIG. 6.

A pin 25 passes transversely through the damper support 104 and gives anchorage to one end of a damper wire 26, the other end of which is fixed to the center of gravity of a damper 106, the latter being provided with two felts 29*a* and 29*b* which, when at rest, are in contact with the string 107.

The manner in which the assembly described above operates is illustrated in FIGS. 3 to 6.

Figure 3:
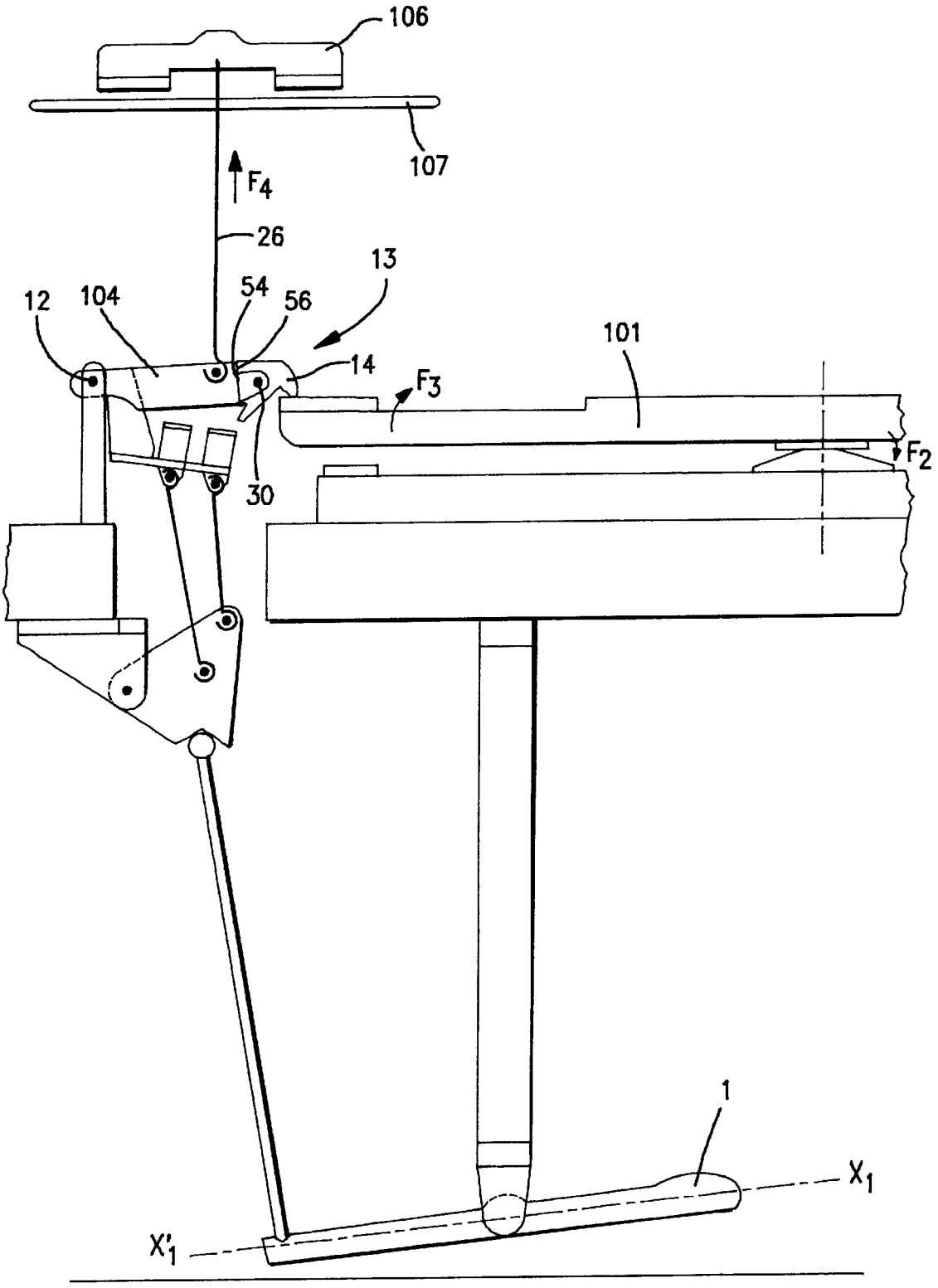
FIG. 3 is a schematic view similar to FIG. 2, but with the key pressed down.

FIG. 3 shows the mechanism according to the invention when the key 101 is pressed down (arrow $F_2$), the pedal 1 being in its rest position. The hammer (not shown) associated with said key 101 strikes the string 107 at this point. As can be seen in this figure, as the rear end of the key 101 rotates in direction $F_3$, it lifts the nose 14 of the escapement 13, pivoting it on the pin 30 until the upper area of the stop surface 56 comes into contact with the abutment surface 54; from now on the escapement 13 and the damper support 104 behave as a single integral component pivoting about pin 12. It follows that the wire 26 is raised (arrow $F_4$) and, consequently, that the damper 106 in lifted off the string 107. The note played vibrates in this way until the key 101 is released, when the mechanism returns to the situation shown in FIG. 2.

FIG. 4 illustrates the mechanism according to the invention in the case in which the pedal 1 has been slightly depressed, bringing it to the harmonic position (general direction $X_2$–$X'_2$), while the key 101 in at rest. The pressure applied to the pedal 1, in direction $F_5$, has transmitted, in direction F6, and via the actuation rod 4, a rotary movement $F_7$–$F_8$ to the crank plate 5 about the pin 7 and therefore an upward displacement, via link 19, to the harmonic bar 111 which has come into contact with the fingers 15 of all the escapements such an 13. The configuration of the device, at the moment the pedal 1 is operated, was such that the point of contact between the finger 15 and the harmonic bar 111 was in the plane formed by pins 30 and 40, so that the escapement 13 has not pivoted about pin 30 but has lifted, taking with it the damper support 104 and the wire 26. The same will have happened to all the other escapements, which will have had the effect of lifting all the dampers, such as 106, from the strings, such as 107. The rotation of the crank plate 5 has simultaneously, via link 20, raised the sustaining bar 112.

If, given this position, the key 101 is depressed in direction $F_2$, its rear end will push the nose 14 of the escapement 13 upwards, with the result that the escapement 13 will pivot about pin 30 and the finger 15 will separate from the harmonic bar 111. Next (FIG. 5), if said key 101 is released, the nose 14, being no longer pushed, will follow the rear end of the key 101 as it pivots down, still resting on said key 101 approximately until said key is fully released, and the finger 15 will then be adjacent to the harmonic bar 111, against its front face, i.e. the face nearest the piano keyboard. The damper 106 thus returns to the string 107. All the other dampers remain up because the return of damper 106 to string 107 is the result of the depression of the key 101, the other keys having remained inactive.

Figure 5:
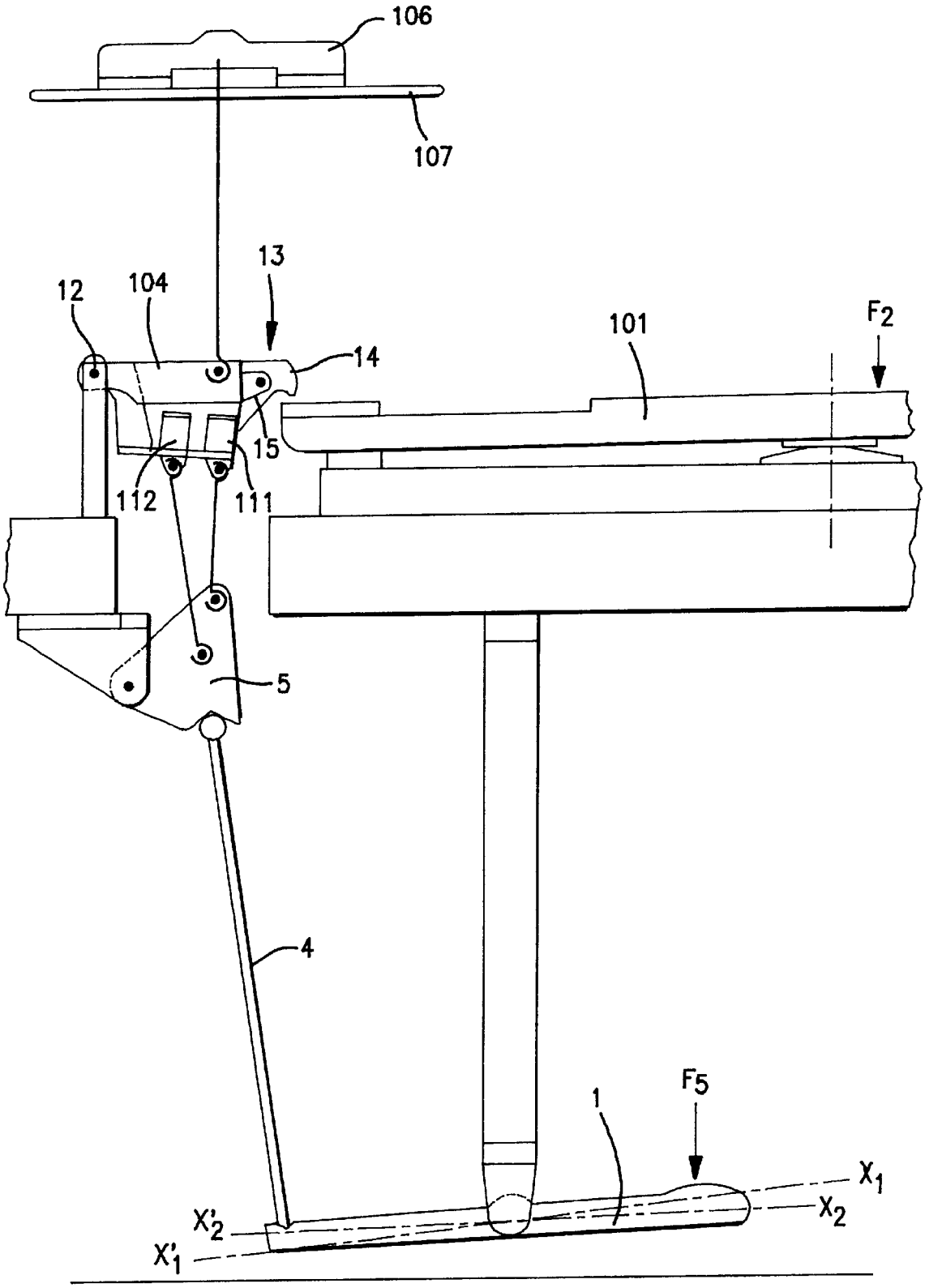
FIG. 5 shows the same embodiment as FIG. 4, after the key has first been depressed and then released.

Certain escapements thus occupy the position of FIG. 4 (corresponding to non-depressed keys) while others occupy the position of FIG. 5 (corresponding to keys that have first been depressed and then released).

If the pedal 1 is now depressed further—but only very slightly—for escapements in the position of FIG. 4, the harmonic bar 111, which is pressing against the row of fingers, such as 15, of the escapements, such as 13, will raise said escapements, taking the noses, such an 14, out of reach of the keys, such as 101, when the latter are pressed down. The escapements are now in a position termed "out of play".

For escapements in the position of FIG. 5, the very slight movement of the pedal 1 described immediately above simultaneously gives rise to an ascending movement of the sustaining bar 112, which comes into contact with the damper support 104 and pivots it a small amount about the pin 12, so that the dampers, such as 106, come off the strings, such as 107, and so that the noses, such as 14, can no longer be reached by the keys, such as 101. In this position, however, the fingers, such as 15, are not back in contact with the harmonic bar 111; the escapements, such as 13, are said to be "not reset".

In each case, for the pianist the effect obtained is that of a sustaining pedal, i.e. all the dampers are off the strings and the notes cannot now be damped, whatever action is taken on the keys. The transition between these two positions—harmonic and out-of-play—is very rapid, that is to say the travel of the pedal is very small. In other words a threshold effect has been created in the sense that, as soon as the pedal passes the harmonic position it behaves as a sustaining pedal however far it is depressed.

If the pedal 1 is further depressed in direction $F_{12}$ (pedal fully depressed; general direction $X_3$–$X'_3$ FIG. 6), the crank plate 5 will eventually reach a position such that the pin 16 is as high as it will go, meaning that the harmonic bar 111 cannot be lifted any higher. The sustaining bar 112, for its part, continues its upward movement, such that the two links 19 and 20 eventually cross, as illustrated in FIG. 6. In this figure, the sustaining bar 112 has come into contact with the row of damper supports, such as 104, of which the escapements, such as 13, were previously in the out-of-play position described earlier. The sustaining bar 112 has simultaneously pivoted the damper supports (such as 104) associated with the other, non-reset escapements further upwards about the pin 12, with the result that the fingers, such as 15, of the escapements, such as 13, are now above the harmonic bar 111. In addition, all the dampers are in the same plane. From this position, the pedal 1 has only to be released a very small amount for all the escapements to be "set" or "reset". The situation shown in FIG. 4 can easily be restored by further releasing the pedal 1 until the harmonic position is reached. In this way, even if a note has been played in the harmonic position by pressing and then releasing the key 101 (FIG. 5), in which position said note has been damped, and then replayed in the sustaining position, in which said note has not been damped, this note will continue to vibrate even after a return to the harmonic position (FIG. 4). This did not happen with known mechanisms. It will be observed that "resetting" also occurs when the pedal 1 returns to a position very close to the position illustrated in FIG. 2, that is by first releasing it completely and then very slightly pressing it down.

A second embodiment of the mechanism according to the invention is shown in FIGS. 9 to 11, in which parts of the structure that are identical or similar to parts already described with reference to FIGS. 2 to 6 are given the same reference numerals, augmented by one hundred. These parts will not therefore be described a second time.

As shown in FIG. 9, which illustrates the mechanism according to the invention at rest, this embodiment uses, instead of the crank plate 5 illustrated in the previous FIGS, a pair of levers 60, 61 that are hinged to each other and to the supporting yoke 108 at one end 60*a*, 61*a*, by the pin 107. The levers 60, 61 are additionally connected to each other, at their other ends 60*b*, 61*b*, by a compression spring 63 which, in the configuration illustrated in this figure, is not compressed.

The end 61*b* of lever 61 possesses on its lower face—the normal direction of use of the piano—a step 61*b*' which is designed to define, with an identical step 60*b*', in the end 60*b* of lever 60, a cavity in which to accommodate the spring 63 when the levers 60, 61 are placed against each other. Furthermore, the upper face of end 61*b* of lever 61 is designed to be pushed against a stop piece 64 fitted with a buffer pad and projecting down from the underside of the horizontal key bed of the grand piano. Between its ends 61*b* and 61*a*, the lever 61 comprises in succession a recess 65 holding the hemispherical end of an elongate link-supporting component 66 that accommodates the near end of link 119, then a hole 67 through which there projects a longitudinal portion of a similar elongate component 68 that accommodates the near end of link 120, and lastly a fixing point to which a compression spring 69 is fixed to connect the lever 61 to the key bed 109.

Meanwhile the end 60*b* of lever 60 comprises, on its underside, an approximately right-angled notch 106 which sits on the actuation rod 104. Between its ends 60*b* and 60*a*, lever 60 comprises in succession a damping pad 62 facing lever 61 and a recess 70 similar to recess 65.

The operation of the mechanism in this embodiment is basically the same as that of the mechanism described with reference to FIGS. 2 to 6.

FIG. 10 illustrates the mechanism of FIG. 9 when the dual-action pedal in depressed in the harmonic position and the key 201 is not pushed down. It will be seen that with the pedal in this position, the end 61*b* of lever 61 is pushed against the stop 64, spring 63 not being compressed while spring 69 is. The resistance offered by the stop 64 and the spring 69 enables the pianist to feel where the harmonic position is.

As the pedal 101 is pushed further down all the way into the sustaining position, the spring 63 is progressively compressed until levers 60 and 61 come together, as illustrated in FIG. 11 which shows the mechanism in the sustaining pedal position. The coming together of the levers 60, 61 is limited by the pad 62, the purpose of which is to deaden any noise and reduce wear on the levers 60, 61. Their coming together indicates to the pianist that he has reached the sustaining position of the pedal.

The mechanism an applied to the upright piano, as illustrated in FIGS. 7 and 8, does not differ fundamentally from the mechanism discussed with reference to FIGS. 2 to 6. In these figures, parts similar to those of FIGS. 2 to 6 are given identical reference numerals followed by the "prime" mark. As FIG. 7 shows, the mechanism according to the invention, when applied to an upright piano, differs essentially from the prior art, as represented by FIG. 1, in that the spoon 103 acts not directly on the damper support 104', but through an escapement 13' on which the harmonic bar 111' is also able to act. More precisely, the spoon 103, which may be made of, for example, a resilient metal, is connected to a spoon support 43 which in turn is connected to the key (not shown) and can pivot in the opposite sense to said key. The spoon 103 is in contact with a right-angled nose 14', formed in one piece with the escapement 13' and containing a housing for one end of a helical spring 42, the other end of which is fixed to the damper support 104'. The damper support 104', can pivot on a pin 48 mounted on a horizontal part 45, which part 45 is itself mounted on the vertical portion 31 of the piano. The damper support 104, is held at rest against the string 107' by a compressor spring 44 fixed to part 45. As with all upright pianos, the damper 106', and the string 107' are vertical too.

In addition to the harmonic bar 111' there is a sustaining bar 112', and these bars are fixed to corresponding series of supports 22' and 23', respectively, which are pivoted to a pin 12'. When at rest, the harmonic bar 111' is in contact with the finger 15' of the escapement 13'.

FIG. 8 shows the detail of a linkage mechanism according to the present invention, consisting of an actuation rod 4' with one end supporting a crank plate 5', the shape of which differs significantly from that of crank plate 5 of FIGS. 2 to 6; the basic structure of this crank plate 5' is roughly trapezoidal, its short base containing a cutout 52 of irregular form, in part of which the ball end of the actuation rod 4' is wedged. The crank plate 5' pivots about a transverse pin 7' in the vertex 5' *b* of the trapezoid, with respect to a yoke 8', which in this case is fixed to the above-mentioned vertical portion 31 of the structure of the upright piano. A link 19' is anchored in a pivoting manner, at one end, about a pin 16' driven into the crank plate 5' at its corner 5' *c* and, at its other end, about a pin 40', driven into a plate 47' used for shifting the harmonic bar 111'. In the same way, a link 20' is anchored in a pivoting manner, at one end, about a pin 17', driven into the crank plate 5' at its corner 5' *a* and, at its other end, about a pin 41' driven into a plate 48', used for shifting the sustaining bar 112'.

The assembly operates in basically the same way as the mechanism described with reference to FIGS. 2 to 6. In particular, the respective actions of the sustaining bar 112' on the row of damper supports, such as 104', and of the harmonic bar 111' on the row of fingers, such as 15', of escapements, such as 13', is the same. However, some differences result from the fact that the string 107', the damper 106' and its support 104', are vertical rather than horizontal. Thus, where the mechanism is adapted to the grand piano, the rear end of the key 101 can (as far as the harmonic position) come directly into contact with the nose 14 of the escapement 13, as was described earlier, and can lift said escapement when the key 101 is depressed, giving rise to an upward pivoting of the damper support 104 on which said escapement 13 is pivotably mounted, and hence to the separation of the damper 106 from the string 107, on which it normally rests. When the key 101 is released the escapement 13, which is free of any constraint, returns under gravity to its rest position. Where the mechanism is adapted to the upright piano, as illustrated in FIG. 7, when the key (not shown) is slightly depressed, the spoon support 43 pivots in direction $F_9$, and with it the spoon 103 which, on pushing the nose 14', pivots the escapement 113' in direction $F_{10}$ in opposition to the force of the spring 42, thereby compressing it. When the key is approximately halfway through its stroke, the base of the nose 14' meets the lower end of the damper support 104'. Then, the escapement 13' having reached its position of greatest retraction, if the key is depressed any further the damper support 104' itself will be forced to pivot about the pin 48. The compressor spring 44 is then deformed in direction $F_{11}$ and the damper is moved back from the string 107'. When the key is released, the spring 42 distends once again; the escapement 13' then resumes its rest position as illustrated in FIG. 7, and the damper moves back onto the string under the action of the compressor spring 44. It will be appreciated that in order for this mechanism to operate correctly, the tension of spring 44 must be greater than that of spring 42.

It will thus be clear from the foregoing description that the invention enables a player to effect a series of transitions back and forth between the harmonic function and the sustaining function, with intermediate sequences of damped notes (keys released without simultaneous depression of the pedal or in the harmonic position) and some number of notes which remain undamped to the end (keys released beyond the harmonic position), provided the pedal has at no point been completely released.

In addition, the transition from the sustaining function to the harmonic function, and vice versa, is precisely regulated by construction and will depend on the dimensions and relative positions of the various components described above. The transition between these two functions can be made easier to sense for the pianist by adding to the mechanism a movable mechanical part which, as the pedal passes the harmonic position, encounters an obstacle that will give the pianist a sensation of having to overcome a point of resistance in the travel of the pedal.

Other parameters can be regulated, in particular the length of the total travel of the pedal—by varying the length of the actuation rod—and/or the position of the harmonic point in the travel of the pedal—which may vary by about 10% around the position corresponding to half the pedal travel.

I claim:

1. A pedal mechanism for a musical instrument having plural keys and corresponding struck strings which are individually damped when a respective one of plural dampers is actuated, the pedal mechanism comprising:

plural damper supports, each for actuating a respective one of the dampers;

a sustaining bar for actuating a plurality of said damper supports;

plural escapements, each movable from an actuation position adjacent a respective one of the keys for being selectively actuated by the respective one of the keys to a neutral position out of range of actuation by the keys, and that are each attached to a respective one of said damper supports;

a harmonic bar for actuating a plurality of said escapements; and a pedal having a first partially depressed harmonic position and a second fully depressed sustaining position, said pedal being connected by a linkage system to said sustaining bar and to said harmonic bar to actuate said sustaining bar and said harmonic bar, said linkage system being arranged and constructed so that when said pedal is depressed beyond the harmonic position, the plurality of said escapements actuated by said harmonic bar are moved from the actuation position to the neutral position, and so that when said pedal is depressed to said sustaining position and then released short of the harmonic position, the plurality of said escapements actuated by said harmonic bar are engaged with said harmonic bar.

2. The pedal mechanism of claim 1, wherein said linkage system comprises an actuation rod operated by said pedal, a first link pivotally connected to said sustaining bar, and a second link pivotally connected to said harmonic bar, said first and second links being pivotally actuated by said actuation rod.

3. The pedal mechanism of claim 2, wherein said linkage system further comprises a crank plate, said first and second links being pivotally attached to said crank plate and said actuation rod being arranged and constructed to cause pivoting motion of said crank plate.

4. The pedal mechanism of claim 2, wherein said linkage system further comprises two levers pivotally connected at their one ends and urged apart by spring means at their other ends, said actuation rod acting on the other end of one of said levers and said first and second links being actuated by the other end of a second of said two levers.

5. The pedal mechanism of claim 1, wherein each of said escapements pivots freely on the respective one of said damper supports between a position of abutment against the respective one of said damper sup ports and either a position of equilibrium defined by gravity or a position in which it bears on one of said harmonic bar and the respective one of the keys.

6. The pedal mechanism of claim 1, wherein each of said escapements pivots on the respective one of said damper supports and comprises spring means for urging it to a position.

7. The pedal mechanism of claim 1, wherein each of said escapements comprises two areas of contact, one for contacting said harmonic bar and a second for contacting the respective one of the keys.

8. A method of operating a pedal mechanism for a musical instrument having plural keys and corresponding struck strings which are individually damped when a respective one of plural dampers is actuated, plural damper supports, each for actuating a respective one of the dampers, a sustaining bar for actuating a plurality of the damper supports, plural escapements, each movable from an actuation position adjacent a respective one of the keys for being selectively actuated by the respective one of the keys to a neutral position out of range of actuation by the keys, and that are each attached to a respective one of the damper supports, a harmonic bar for actuating a plurality of the escapements, and a pedal connected to the sustaining bar and the harmonic bar, the method comprising the steps of:

partially depressing the pedal beyond a first harmonic position to move the plurality of the escapements actuated by the harmonic bar from the actuation position to the neutral position; and completely depressing the pedal to a second sustaining position and then releasing the pedal to a position short of the harmonic position to engage the plurality of the escapements actuated by the harmonic bar with the harmonic bar.

* * * * *